US009640906B2

(12) United States Patent
Wojcik et al.

(10) Patent No.: US 9,640,906 B2
(45) Date of Patent: May 2, 2017

(54) MULTI-POSITION QUICK RELEASE PLUG CASSETTE ASSEMBLY

(71) Applicant: Panduit Corp., Tinley Park, IL (US)

(72) Inventors: Alan F. Wojcik, Cedar Lake, IN (US); Paul B. DuCharme, New Lenox, IL (US)

(73) Assignee: Panduit Corp., Tinley Park, IL (US)

( * ) Notice: Subject to any disclaimer, the term of this patent is extended or adjusted under 35 U.S.C. 154(b) by 0 days.

(21) Appl. No.: 14/944,593

(22) Filed: Nov. 18, 2015

(65) Prior Publication Data

US 2016/0126668 A1 May 5, 2016

Related U.S. Application Data

(63) Continuation of application No. 14/099,129, filed on Dec. 6, 2013, now Pat. No. 9,203,202, which is a (Continued)

(51) Int. Cl.

| | |
|---|---|
| ***H01R 4/24*** | (2006.01) |
| ***H01R 13/627*** | (2006.01) |
| ***H01R 13/506*** | (2006.01) |
| ***H01R 13/508*** | (2006.01) |
| ***H01R 13/514*** | (2006.01) |
| ***H01R 13/518*** | (2006.01) |
| ***H01R 13/633*** | (2006.01) |
| ***H01R 25/00*** | (2006.01) |
| ***H01R 13/502*** | (2006.01) |
| ***H01R 43/26*** | (2006.01) |

(Continued)

(52) U.S. Cl.

CPC ..... *H01R 13/6271* (2013.01); *H01R 13/502* (2013.01); *H01R 13/506* (2013.01); *H01R 13/508* (2013.01); *H01R 13/514* (2013.01); *H01R 13/518* (2013.01); *H01R 13/6335* (2013.01); *H01R 25/006* (2013.01); *H01R 43/26* (2013.01); *H01R 13/62933* (2013.01); *H01R 24/64* (2013.01); *Y10T 29/49117* (2015.01)

(58) Field of Classification Search

CPC ..... H01R 13/6271; H01R 43/26; H01R 13/62933; H01R 24/64; H01R 13/514; H01R 13/506; H01R 13/6335; H01R 13/502; H01R 13/513; H01R 13/62; H01R 9/038; H01R 25/006; H01R 13/518; H01R 13/508; Y10T 29/49117

USPC ..... 439/394

See application file for complete search history.

(56) References Cited

U.S. PATENT DOCUMENTS 2,876,389 A 3/1959 Lang
3,015,082 A 12/1961 Meacham
(Continued)

*Primary Examiner* — Jean F Duverne

(74) *Attorney, Agent, or Firm* — Christopher S. Clancy; James H. Williams; Christopher K. Marlow

(57) ABSTRACT

A cassette assembly which holds at least two electrical plugs which typically are connected to digital signal carrying cables. In one example, six of these plugs are positioned within a cassette, and are arranged in two rows of three plugs each for ease in connecting the plugs simultaneously to similarly arranged switch port jacks. A lever pivotally connected to the housing, when rotated, causes the release latch of the plugs held within the cassette to move from a locked to an unlocked position to simultaneously remove all of the plugs from the jacks to which they are connected.

14 Claims, 12 Drawing Sheets

Related U.S. Application Data continuation of application No. 13/862,715, filed on Apr. 15, 2013, now Pat. No. 8,602,807, which is a continuation of application No. 13/432,229, filed on Mar. 28, 2012, now Pat. No. 8,425,247, which is a continuation of application No. 12/137,226, filed on Jun. 11, 2008, now Pat. No. 8,167,638.

(60) Provisional application No. 60/992,450, filed on Dec. 5, 2007, provisional application No. 60/943,413, filed on Jun. 12, 2007.

(51) Int. Cl.
*H01R 13/629* (2006.01)
*H01R 24/64* (2011.01)

(56) References Cited

U.S. PATENT DOCUMENTS 3,019,406 A 1/1962 Slater
3,860,316 A 1/1975 Hardesty
3,950,070 A 4/1976 Groft et al.
4,201,437 A 5/1980 Lockyer
4,241,974 A 12/1980 Hardesty
4,575,168 A 3/1986 Thomas
4,611,875 A 9/1986 Clarke et al.
4,647,726 A 3/1987 Blum
4,787,706 A 11/1988 Cannon, Jr. et al.
4,953,929 A 9/1990 Basista et al.
5,076,656 A 12/1991 Briggs et al.
5,121,454 A 6/1992 Iwano et al.
5,123,071 A 6/1992 Mulholland et al.
5,224,186 A 6/1993 Kishimoto et al.
5,234,357 A 8/1993 Yamaguchi
5,312,268 A 5/1994 Sumida
5,335,301 A 8/1994 Newman et al.
5,386,487 A 1/1995 Briggs et al.
5,556,295 A 9/1996 McFadden et al.
5,579,425 A 11/1996 Lampert et al.
5,675,682 A 10/1997 De Marchi
5,700,156 A 12/1997 Bussard et al.
6,024,498 A 2/2000 Carlisle et al.
6,234,826 B1 5/2001 Wilber et al.
6,254,418 B1 7/2001 Tharp et al.
6,261,116 B1 7/2001 Ceru
6,332,798 B1 12/2001 Farooq
6,357,934 B1 3/2002 Driscoll et al.
6,547,585 B2 4/2003 Bradley et al.
6,672,898 B2 1/2004 Kahle et al.
6,796,844 B1 9/2004 Edwards, III
6,857,900 B2 2/2005 Kleeberger et al.
7,140,911 B1 11/2006 Rector et al.
7,354,291 B2 4/2008 Caveney et al.
7,374,447 B2 * 5/2008 Matsumoto ..... H01R 13/518 439/344
7,381,087 B2 6/2008 Alvarez
8,414,324 B2 * 4/2013 Reed ..... H01R 9/038 439/345
8,425,247 B2 4/2013 Wojcik et al.
8,794,998 B2 * 8/2014 Hashimoto ..... H01R 13/62 439/344
2002/0137392 A1 9/2002 Wainio

* cited by examiner

MULTI-POSITION QUICK RELEASE PLUG CASSETTE ASSEMBLY

CROSS REFERENCE TO RELATED APPLICATION

This application is a continuation of U.S. patent application Ser. No. 14/099,129, filed Dec. 6, 2013, which will issue as U.S. Pat. No. 9,203,202 on Dec. 1, 2015; which is a continuation of U.S. patent application Ser. No. 13/862,715, filed Apr. 15, 2013, now U.S. Pat. No. 8,602,807; which is a continuation of U.S. patent application Ser. No. 13/432,229, filed Mar. 28, 2012, now U.S. Pat. No. 8,425,247; which is a continuation of U.S. patent application Ser. No. 12/137,226, filed Jun. 11, 2008, now U.S. Pat. No. 8,167,638; which claims the benefit of U.S. Provisional Patent Application No. 60/992,450, filed Dec. 5, 2007 and U.S. Provisional Patent Application No. 60/943,413, filed Jun. 12, 2007. Each of these applications is incorporated by reference in its entirety.

FIELD OF INVENTION

This invention relates generally to connecting cables to switches and is particularly directed to a gang-type plug cassette capable of holding multiple plugs which permit connecting multiple plugs simultaneously into switch port jacks.

SUMMARY OF THE INVENTION

A cassette assembly which includes a housing for holding at least two electrical plugs wherein each of the plugs includes a release latch and wherein the housing includes two spaced apart sidewalls and a lever pivotally connected to the housing such that rotation of the lever causes the release latch of at least one of the electrical plugs to move from a latched position to an unlatched position.

A cassette assembly which includes a housing for holding at least two electrical plugs and a housing clip comprising a generally planar body and at least one projection extending from a side of the body in a direction away from the body wherein the projection is positioned in a path of removal of a plug from the housing with the housing clip positioned in the housing.

A locking clip which includes a generally U-shaped body which has opposing arms, a compression resistant member positioned between the opposing arms of the generally U-shaped body and a tab positioned on each arm of the generally U-shaped body wherein each tab is adapted to engage a separate aperture defined in a cassette plug housing.

A cassette assembly includes a sidewall of a housing wherein the housing is capable of holding at least two electrical plugs, another sidewall of another housing capable of holding at least two electrical plugs and a bridge clip which includes converging opposing sidewalls and a locking tab extending from each opposing sidewall in a direction between the converging opposing sidewalls, wherein the converging opposing sidewalls are adapted to receive between the converging sidewalls the sidewall of the housing and the other sidewall of the other housing, wherein one locking tab projects through an opening defined in the sidewall the other locking tab projects through another opening defined in the other sidewall.

DETAILED DESCRIPTION

As shown in FIGS. 1-8, in one example, the quick release plug cassette assembly 10 includes a generally rectangular housing 12 preferably comprised of a high strength plastic.

Figure 1:
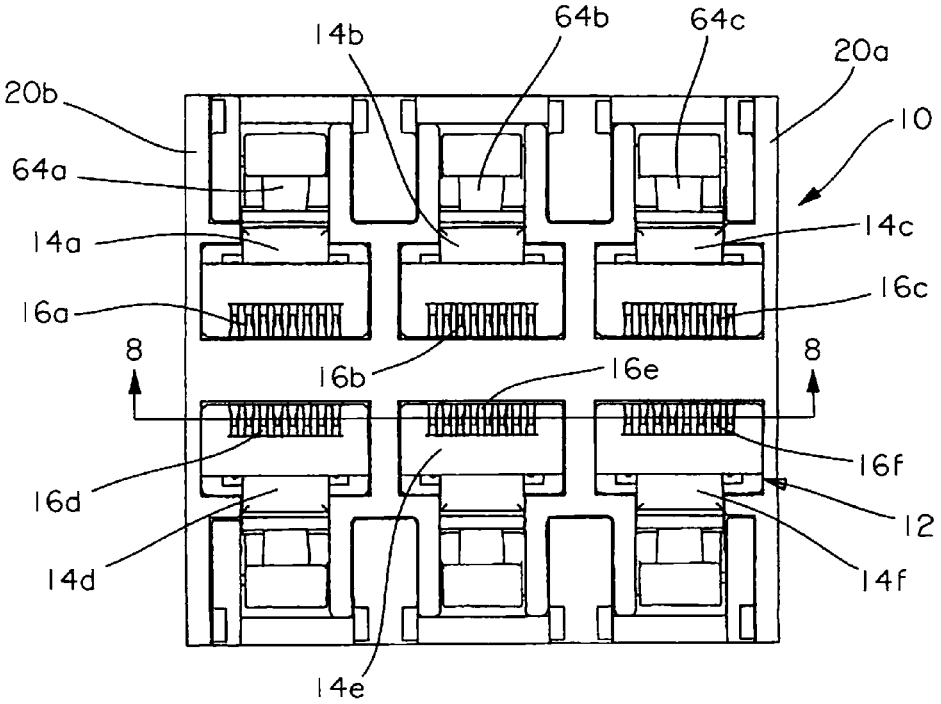
FIG. 1 is a front plan elevational view of an example of a quick release plug cassette assembly with multiple plugs connected thereto.
Figure 13:
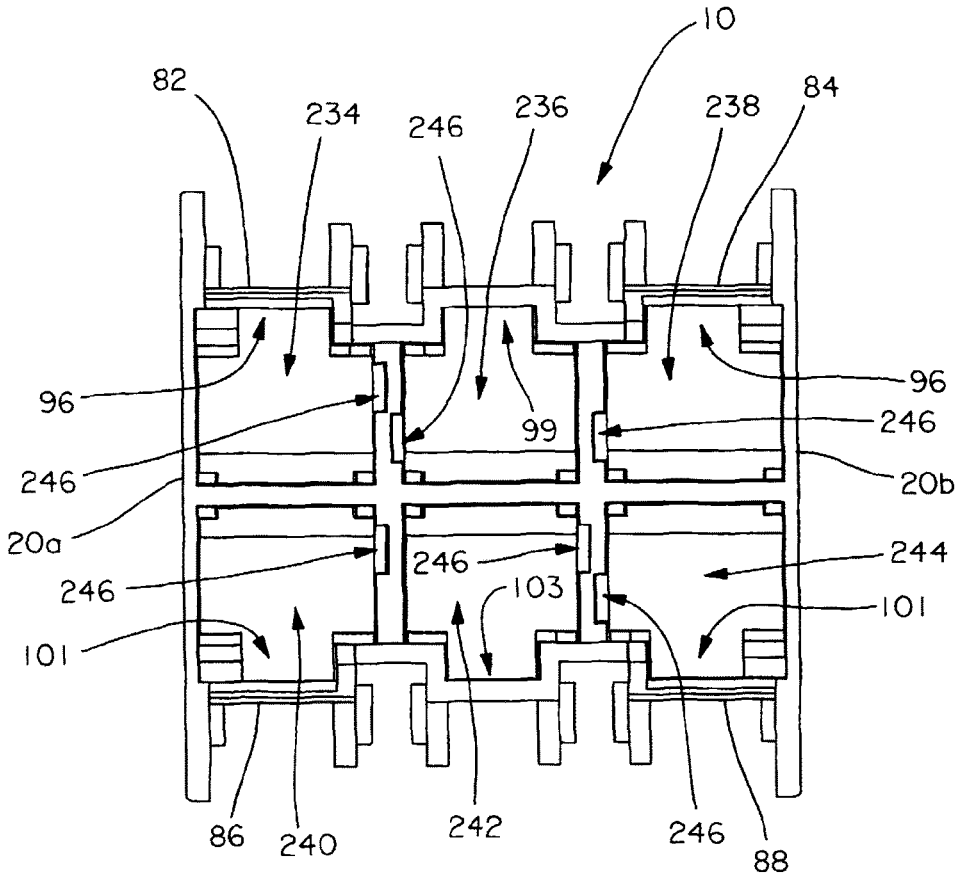
FIG. 13 is a rear plan elevational view of the cassette assembly without upper and lower release levers and without upper and lower plug release actuators.
Figure 14:
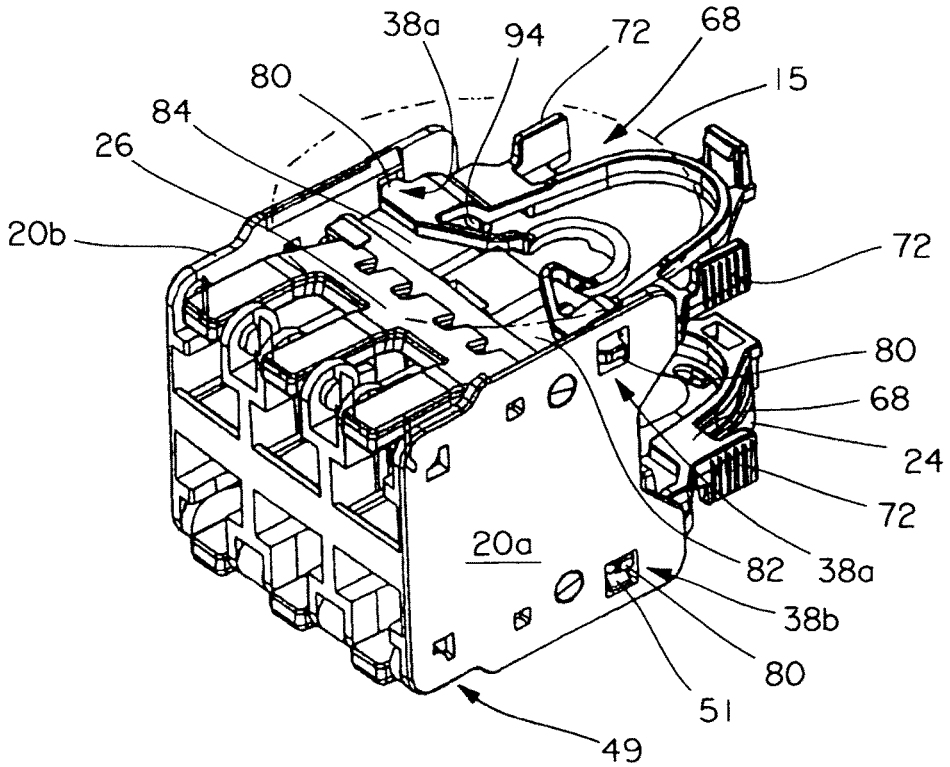
FIG. 14 is a top front perspective view of the cassette assembly of FIG. 12.

Housing 12 includes first and second generally planar opposing spaced apart sidewalls 20*a* and 20*b* which are connected by various internal structures illustrated in the various figures and described below to form a rigid structure. The internal structure of one of the embodiments shown herein, as seen in FIG. 13 includes two rows of receptacles 234, 236, 238, 240, 242 and 244 which hold plugs 14*a*, 14*b*, 14*c*, 14*d*, 14*e* and 14*f* respectively, as seen in FIG. 1. Each of plugs 14*a*-14*f* carry release latches 64*a*-64*f* respectively. A notch 49, as seen in FIG. 14, is positioned adjacent the side of cassette assembly 10 which accesses the plugs for connection, as seen in FIG. 1. Notch 49 provides a clearance for cassette assembly 10 when the plugs contained in assembly 10 are being connected to certain network switches. Such switches have portions of their switch assembly project outwardly and would otherwise prevent plugs contained in the cassette assembly 10 from engaging their intended jacks should notch 49 not be present.

Housing 12, in this embodiment, is adapted to receive first through sixth patch cord plugs 14*a*-14*f*. Each of the plugs 14*a*-14*f* is coupled to a respective end of first through sixth patch cord cables 18*a*-18*f*. Each of the first through sixth plugs 14*a*-14*f* includes respective sets of electrical contacts 16*a*-16*f* for electrical connection to complementary sets of electrical contacts in switches which are not shown in the figures for simplicity, as seen in FIGS. 1-5. Also, attached to respective upper and lower portions of the first and second sidewalls 20*a* and 20*b* are an upper release lever 22 and a lower release lever 24 utilized to simultaneously unlock and lock the plugs contained in housing 12.

Figure 5:
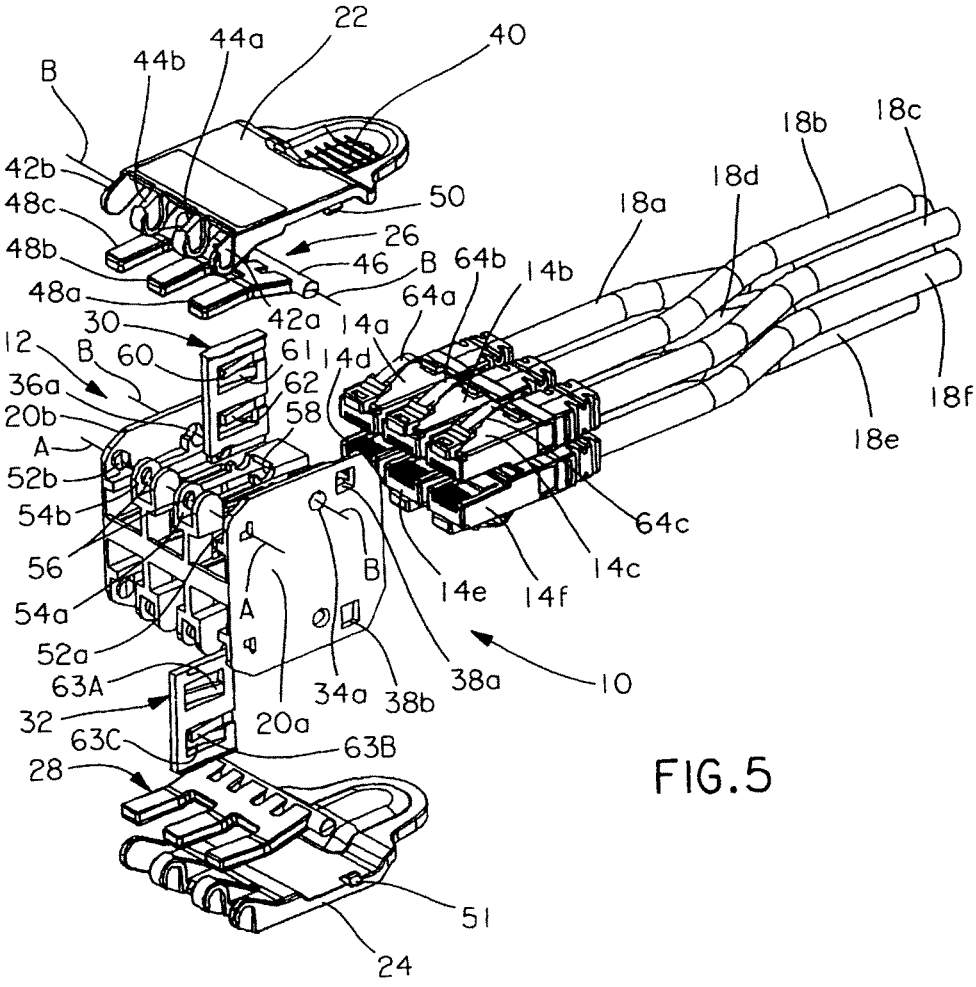
FIG. 5 is an exploded perspective view of the quick release plug cassette assembly of FIG. 1.
Figure 6:
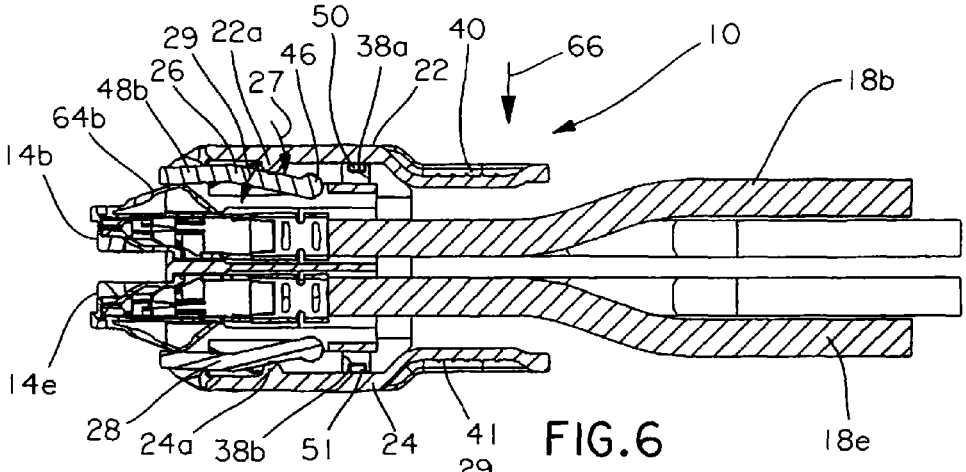
FIG. 6 is a sectional view of the quick release plug cassette assembly shown in FIG. 4 taken along section line 6-6 therein.
Figure 7:
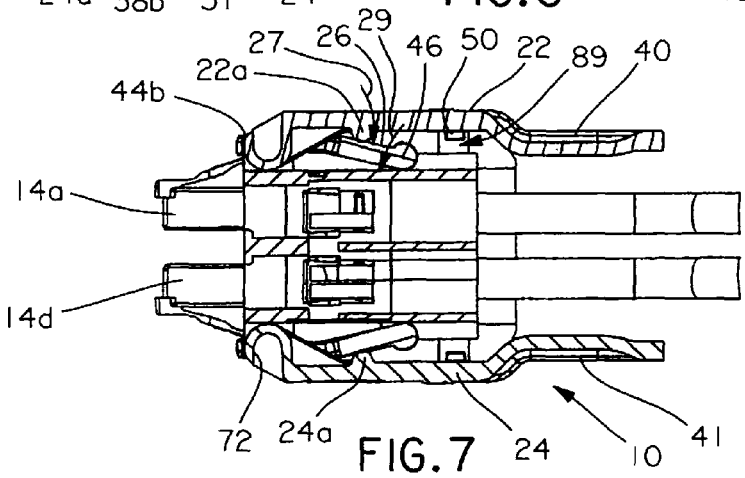
FIG. 7 is a sectional view of the quick release plug cassette assembly shown in FIG. 4 taken along section line 7-7 therein.

The upper and lower release levers 22 and 24 are identical in configuration, operation and positioning within housing 12. Therefore, only the upper release lever 22 will be described in detail herein. As seen in FIG. 5, upper release lever 22 includes a generally flat extended portion 40 having on a first forward end thereof plural connecting elements. These connecting elements include first and second outer, or edge, pivoting connectors 42*a* and 42*b* and first and second inner pivoting connectors 44*a* and 44*b*. Each of the first and second outer pivoting connectors 42*a* and 42*b* includes a recessed, outer curvilinear portion which is adapted to engage a respective one of first and second outer retaining members 52*a* and 52*b* disposed on the inner surfaces of the first and second sidewalls 20*a* and 20*b*, respectively. Lever 22 can be pivotally connected by hand by engaging curvilinear portions of connectors 42*a* and 42*b* to outer retainer members 52*a* and 52*b*, positioned on opposing spaced apart sidewalls 20*a* and 20*b*, respectively. The connection between the upper release lever's outer connectors 42*a* and 42*b* with the outer retaining members 52*a* and 52*b* permits the upper release lever 22 to be pivotally displaced within housing 12 about an axis A, a seen in FIG. 5, defined by the first and second outer retaining members 52*a* and 52*b*. Each of the first and second inner pivoting connectors 44*a* and 44*b* includes a pair of opposed recessed curvilinear portions. Similarly, with the engaging of the outer connectors 42*a* and 42*b* to outer retainer members 52*a* and 52*b* each of the inner pivoting connectors 44*a* and 44*b* of the upper release lever 22 is adapted for insertion in respective first and second inner retaining members 54*a* and 54*b* disposed in a forward, upper portion of housing 12. The curvilinear portions of each of the first and second inner pivoting connectors 44*a*, 44*b* are adapted to receive a respective one of a pair of inwardly extending projections 56 within the first and second inner retaining members 54*a* and 54*b* for maintaining the pivoting inner connectors securely within the inner retaining members while allowing for pivoting displacement of the upper release lever 22 within housing 12 about axis A. As can be seen in FIGS. 5 and 6, upper release lever 22 rotates about axis A with application of force on extended portion 40 by one of a user's thumb or opposing fingers. The path of rotation of upper lever 22 is designated as arrow 27, as seen in FIGS. 6 and 7, wherein portion 22*a* of upper lever 22 pushes against upper plug release actuator 26 which is in the path of rotation 27 of upper lever 22. Also disposed within housing 12 are upper and lower plug release actuators 26 and 28. The upper and lower plug release actuators 26 and 28 are identical in configuration, operation and mounting within housing 12, and thus only the upper plug release actuator is described in detail herein.

As seen in FIG. 5, the upper plug release actuator 26 includes an aft cylindrical bar 46. Opposed ends of the aft cylindrical bar 46 are adapted for positioning in respective circular apertures 34*a* and 36*a* in the first and second side walls 20*a* and 20*b*, respectively. The upper plug release actuator 26 is free to pivot about axis B, as seen in FIG. 5, defined by the aft cylindrical bar 46 and passing through the aligned circular apertures 34*a* and 36*a*. With upper lever pushing into actuator 26, actuator 26 rotates about axis B. Extending forward from the aft cylindrical bar 46 are first, second and third arms 48*a*, 48*b* and 48*c*. Path of rotation or pivoting displacement of the upper plug release actuator 26 is designated as arrow 29 in FIGS. 6 and 7, and allows for upward and downward movement of the first, second and third forward extending arms 48*a*, 48*b* and 48*c*. The aft cylindrical bar 46 is disposed along its length within plural concave recesses 58 disposed in a spaced manner between the first and second side walls 20*a*, 20*b* of housing 12. The spaced concave recesses 58 provide support for the upper plug release actuator 26 and maintain it in fixed position within housing 12, while allowing it to pivot about the aforementioned axis B between circular apertures 34*a* and 36*a*, respectively, in the first and second side walls 20*a*, 20*b* of housing 12. The lower plug release actuator 28 is similarly configured and positioned within housing 12.

Thus, upon force being applied to upper lever 22, upper lever 22 rotates about path of rotation 27 wherein actuator 26 lies therein. With portion 22*a* pushing on actuator 26, actuator 26, in turn, rotates along path 29 rotating first, second and third arms 48*a*-48*c* of actuator 26 into release latches 64*c*-64*a* respectively, as seen in FIGS. 1, 5 and 6. Thus, with arms 48*c*-46*a* pushing down on release latches 64*a*-64*c*, respectively, these release latches move from a latched to an unlatched position simultaneously and similarly with pushing lower lever 24 toward housing 12 latches 64*d*-64*f* will also release simultaneously moving latches 64*d*-64*f* from latched to unlatched positions. Removing the downward force from upper lever 22 will remove the force being applied to release latches 64*a*-64*c* causing the resilient latches 64*a*-64*c* to move back to a latched position. Similarly, lower lever 24 operates the same way with respect to latches 64*d*-64*f*. Thus, grasping levers 22 and 24 with a user's thumb and opposing fingers allows the user to easily apply a squeezing or compressing force on levers 22 and 24 thereby releasing all of release latches 64*a*-64*f* to an unlatched position thereby easily allowing the user to remove or insert all of the plugs with respect to a corresponding set of jacks simultaneously.

Also positionable within housing 12 are first and second inner housing clips 30 and 32. As seen in FIG. 5, the first and second inner housing clips 30, 32 are inserted either from the top or from the bottom into housing 12 with the upper and lower release levers 22, 24 aligned generally vertically and, once positioned within the housing, are disposed between adjacent, vertically aligned pairs of plugs. Thus, the second inner housing clip 32 is disposed between a first pair of vertically aligned plugs 14*a* and 14*d* and a second pair of vertically aligned plugs 14*b* and 14*e*. Similarly, the first inner housing clip 30 is disposed between the second pair of vertically aligned plugs 14*b* and 14*e* and a third pair of vertically aligned plugs 14*c* and 14*f*. The first and second inner housing clips 30, 32 are identical in configuration and perform the same function within the quick release plug cassette assembly 10 and, thus, only the first inner housing clip 30 is described in detail herein.

Figure 8:
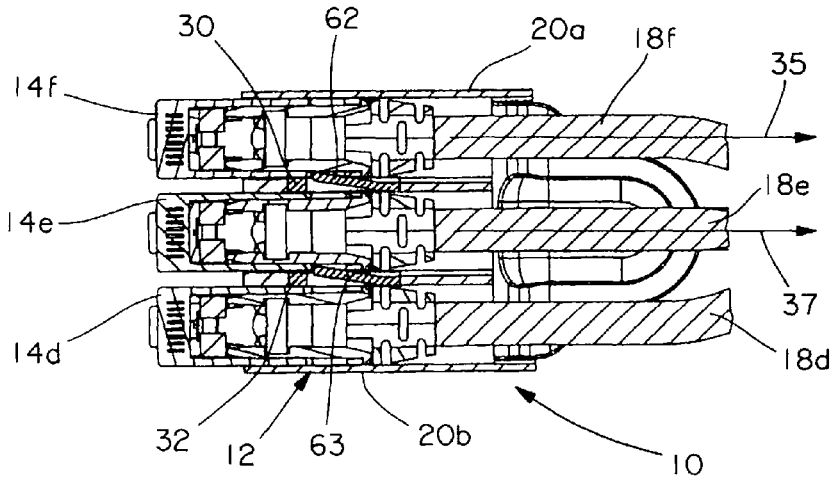
FIG. 8 is a sectional view of the quick release plug cassette assembly shown in FIG. 1 taken along section line 8-8 therein.

The first inner housing clip 30 is generally rectangular and planar in shape and includes first, second and third tabs or projections 60, 62 and 61 extending laterally away therefrom. Each of the first, second and third tabs or projections 60, 62 and 61 is adapted to engage a lateral portion of an adjacent plug so as to prevent the plug from being removed from housing 12 when inner housing clip 30 is in position within the housing. Each of the first and second tabs 60, 62 is angled outwardly in a first direction from the plane of the first inner housing clip 30 so as to engage plugs 14*c* and 14*f*, plugs positioned one over the other, and prevent their removal from housing 12 by blocking the respective plug's path of removal. Third tab 61 extends outwardly from the plane of the first inner housing clip 30 in a second, opposed direction to engage and prevent removal of plug 14*b* positioned laterally from plug 14*c*. As can be seen in FIG. 8, projection 62 blocks plug 14*f* and is positioned in the path of removal of plug 14*f* designated by arrow 35. Projection 62 extends generally in a direction which opposes the direction of the path of removal, designated by arrow 35, of plug 14*f*. Each projection positioned on housing clips 30 and 32, when positioned within cassette assembly 10, positions itself to block a path of removal of a plug positionable within assembly 10. Upon insertion of a tool or screwdriver, plugs 14*b*, 14*c* and 14*f* can be removed either individually by deflecting the corresponding blocking projection toward its generally planar body and displacing the plug in the direction of the cable to which it is connected without disturbing the remaining plugs. As can be seen in FIG. 13, slots 246 are provided within the assembly 10. Slots 246 allow a tool or screwdriver to be inserted therein to cause the deflection of a projection of a housing clip which is in a blocking position of a plug positioned within the corresponding receptacle. The deflection of the projection facilitates the removal of that plug without disturbing other plugs that may be blocked within assembly 10.

Figure 11:
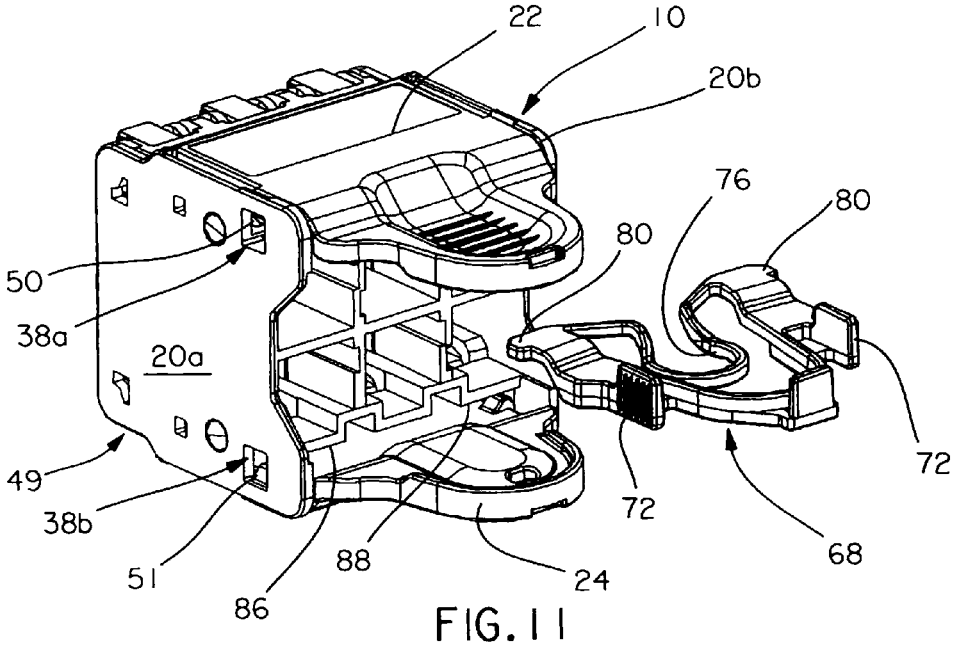
FIG. 11 is an exploded rear perspective view of an embodiment of the cassette assembly and a locking clip.

The quick release plug cassette assembly 10 operates in the following manner to allow for simultaneous connection as well as disconnection of plugs 14*a*-14*f* with a corresponding number of switches or jack ports. The upper and lower release levers 22 and 24 are grasped by the fingers and opposing thumb of a user at respective upper and lower engaging portions 40 and 41. A downward force is applied along and in the direction of arrow 66 to the upper release lever 22, while a corresponding force is applied in the opposite direction to the engaging portion 41 of the lower release lever 24, as seen in FIG. 6. The upper release lever 22 pivots downwardly about an axis which passes through its pivoting connectors, where one of the inner pivoting connectors 44*b* is shown in the sectional view of FIG. 7. The lower plug release lever 24 undergoes a similar pivoting displacement in an upward direction about its corresponding pivoting connectors, where one of the inner pivoting connectors is shown as element 72 in FIG. 7. As described above, each of these pivoting connectors connects forward portions of the upper and lower release levers 22, 24 to a forward portion of housing 12. Pivoting displacement, as seen in FIG. 11, of the upper and lower release levers 22, 24 is respectively limited by the tabs 50 and 51, respectively, attached to the upper and lower release levers and respectively disposed in sidewall apertures 38*a* and 38*b*.

Figure 2:
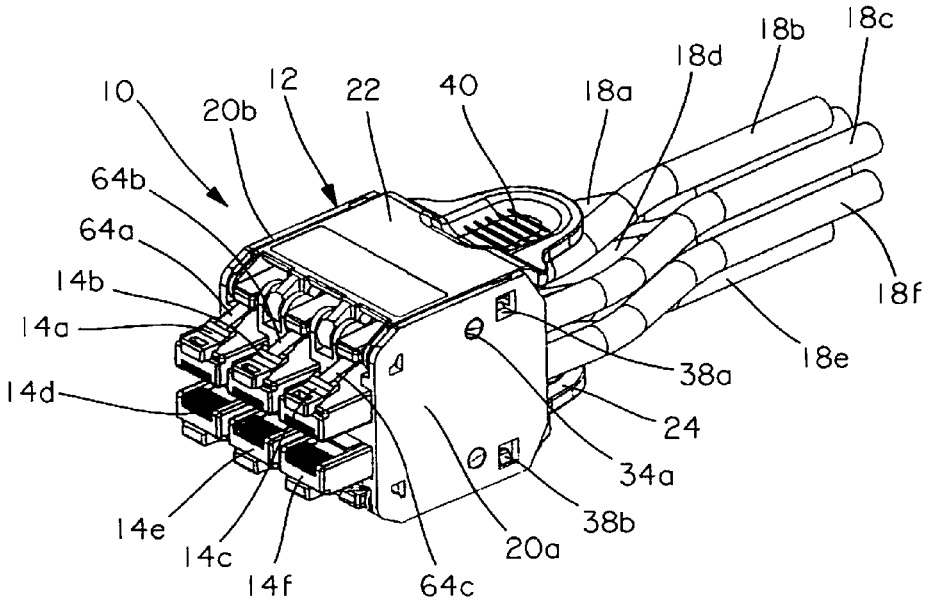
FIG. 2 is an upper front perspective view of the quick release plug cassette assembly of FIG. 1.
Figure 3:
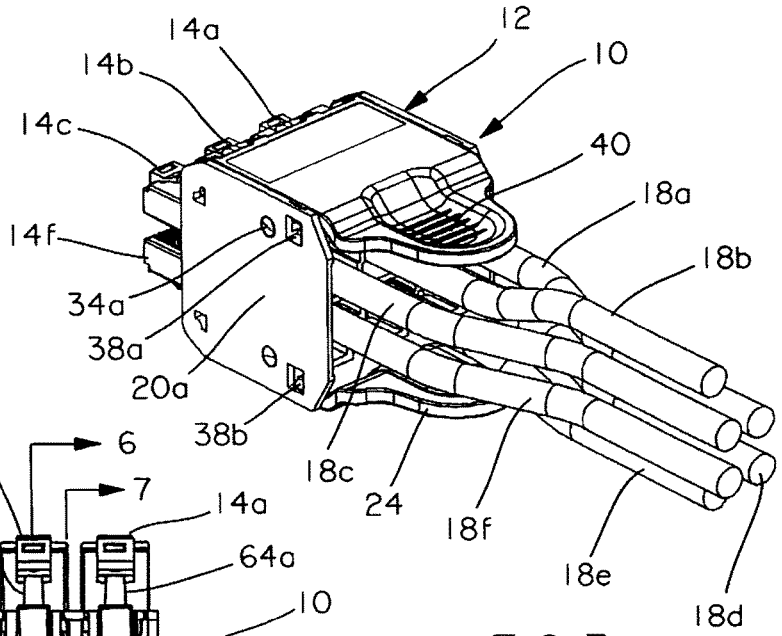
FIG. 3 is an upper rear perspective view of the quick release plug cassette assembly of FIG. 1.
Figure 4:
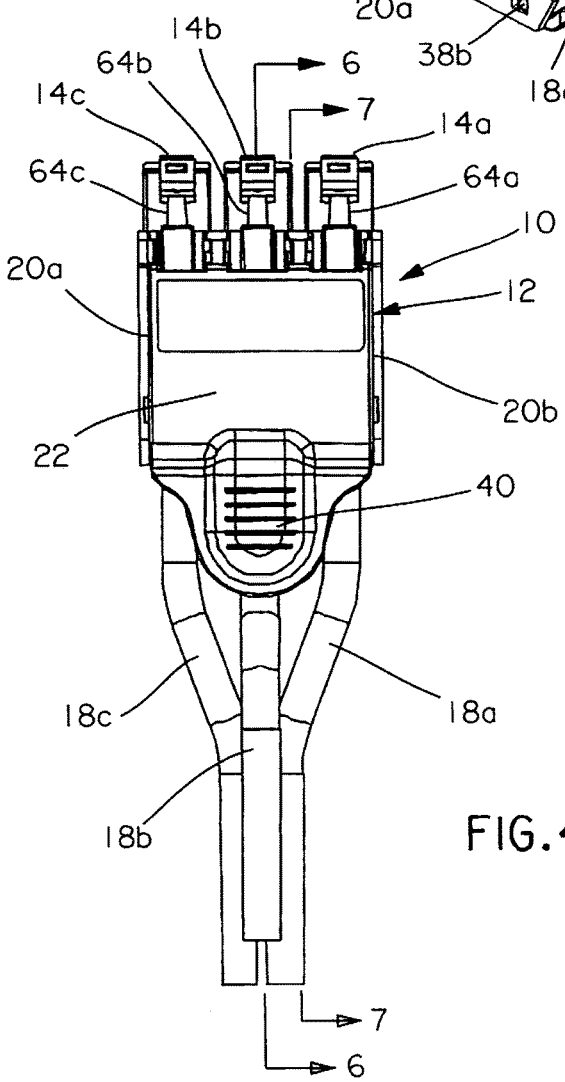
FIG. 4 is a top plan view of the quick release plug cassette assembly of FIG. 1.

Disposed in the respective inner surfaces of the upper and lower release levers 22, 24 are engaging tabs 22*a* and 24*a*, as seen in FIG. 7. Displacement of the upper and lower release levers 22, 24 toward one another causes their respective engaging tabs 22*a* and 24*a* to engage the upper and lower plug release actuators 26 and 28, respectively. The upper plug release actuator 26 is pivotally displaced downwardly about its aft cylindrical bar 46 causing its forward extending arms 48*a*-*c* to engage plug latches 64*c*-*a* disposed on upper portions of plugs 14*c*-*a*, as seen in FIGS. 1, 2 and 5. Plug latches 64*a*-*c* are compressed by engagement with the forward extending arms 48*c*-*a* of the upper plug release actuator 26 allowing the plugs to be withdrawn simultaneously from their corresponding switches or port jacks. Lower release lever 24 operates in the same way as upper release lever 22. Lower release lever 24 engages plug release actuator 28 and in turn, the arms associated with actuator 28 compress plug latches of plugs 14*d*-*f* allowing the plugs to be unlatched and thereafter withdrawn from their corresponding switches. Downward displacement of forward portions of the upper plug release actuator 26 and upward displacement of forward portions of the lower plug release actuator 28 causes corresponding compression of plug latches on each of the six plugs, so as to release all the plugs simultaneously from the switches to which they are connected. Similar operation of the upper and lower release levers 22, 24 and upper and lower plug release actuators 26, 28 combinations is used to simultaneously connect the plural plugs to plural respective switches in accordance with the present invention.

Referring to FIG. 8, there is shown a horizontal sectional view of the quick release plug cassette assembly 10 taken along section line 8-8 in FIG. 1, illustrating the position of the first and second inner housing clips 30 and 32 within housing 12. As shown in the figure, the second inner housing clip 32 is disposed between plugs 14*d* and 14*e*, while the first inner housing clip 30 is disposed between plugs 14*e* and 14*f*. A locking tab 63 extending laterally outward from the second inner housing clip 32 engages a lateral portion of plug 14*e* and prevents it from being removed along its path of removal designated by arrow 37 from housing 12. Similarly, the second locking tab 62 extends laterally from the first inner housing clip 30 and engages a lateral portion of plug 14*f* and prevents this plug from being removed along its path of removal designated by arrow 35 from housing 12.

Figure 9:
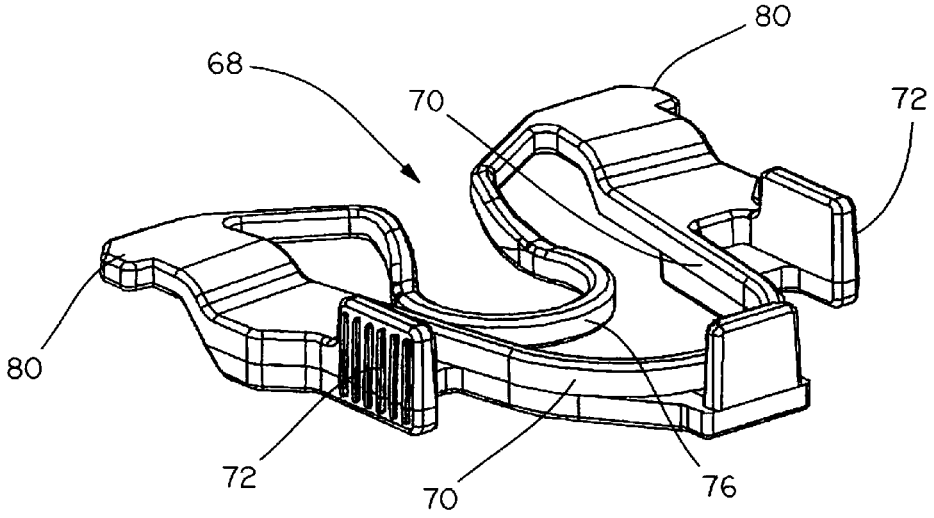
FIG. 9 is a top perspective view of an embodiment of a locking clip.
Figure 10:
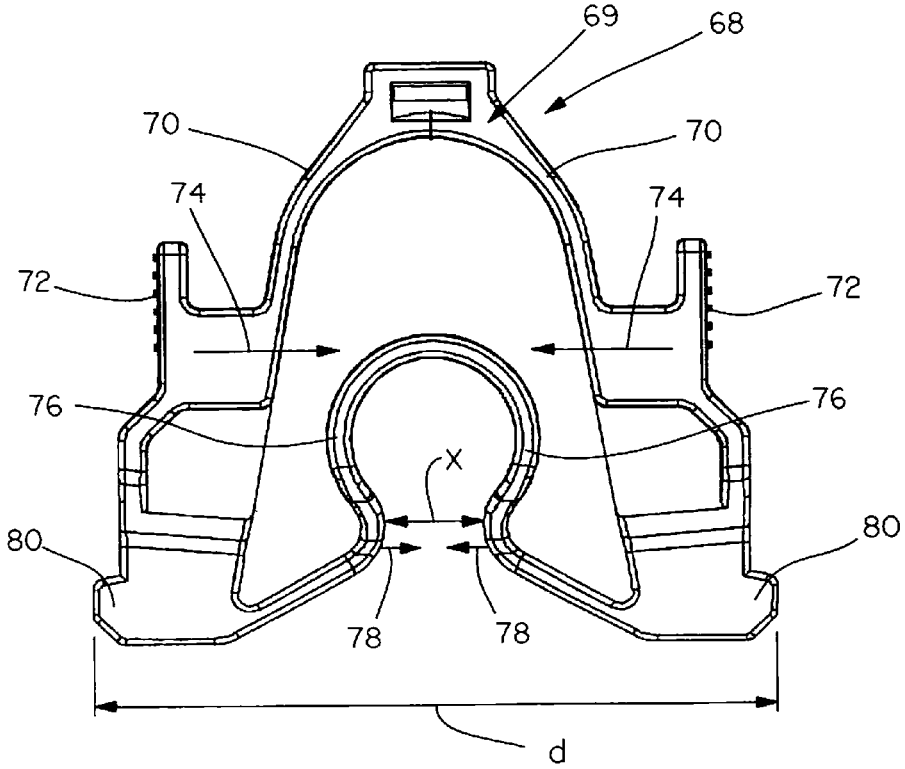
FIG. 10 is a top plan view of the locking clip of FIG. 9.
Figure 16:
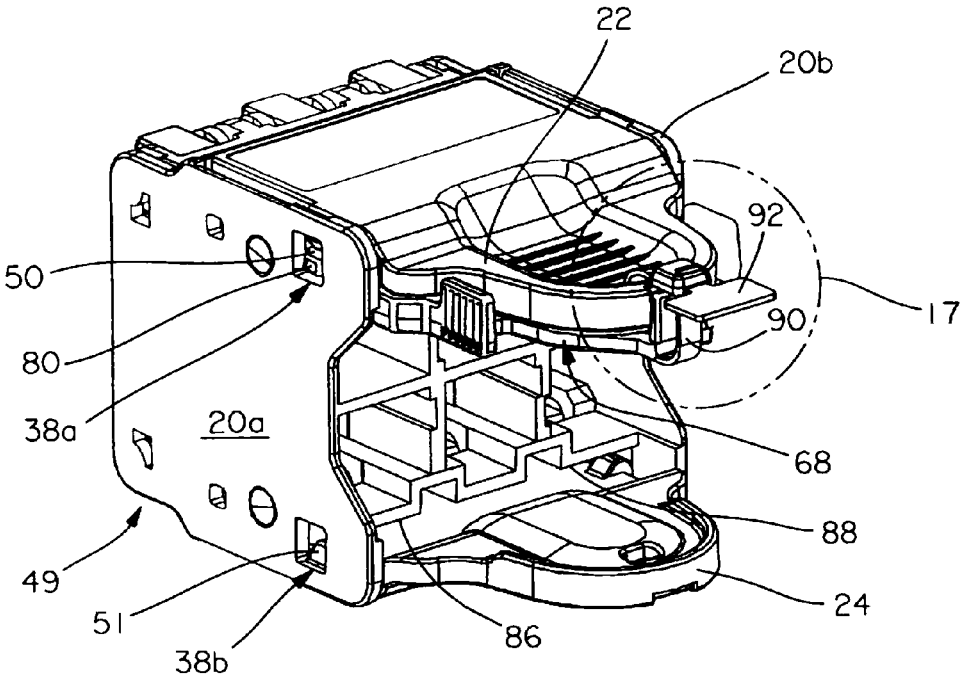
FIG. 16 is a rear perspective view of the cassette assembly of FIG. 11 with a locking clip positioned adjacent to upper release lever in an upper portion of the cassette assembly and lower release lever positioned in a lower portion of cassette assembly without a locking clip.

Locking clip 68 has a generally U-shaped body 69, as seen in FIGS. 9 and 10, As will be described in more detail hereinbelow, locking clip 68 is inserted into cassette assembly 10 adjacent to, as seen in FIG. 16, and in the path of rotation 27 of upper release lever 22, so as to block that lever from moving in a direction toward the other lever 24. Similarly a locking clip 68 can be so positioned with relationship to lower lever 24, as seen in FIG. 14, blocking its rotation as well. Both release levers 22, 24 are blocked from such movement if a locking clip 68 is employed with each of release levers 22, 24. If clip 68 is not employed, for example with release lever 22, that particular release lever could be moved in a direction toward the other release lever 24 thereby unlocking row of plugs 14*a*-14*c* from their electrical connection. A like result occurs to row of plugs 14*d*-14*f* if release lever 24 is allowed to move toward release lever 22. Thus, one entire row of plugs may be unlatched from their switch connection with movement of one of the release levers positioned adjacent to such row of plugs to be unlatched. For a quick disengagement of both rows of plugs 14*a*-14*f*, in this example, release levers 22 and 24 are grasped by the user and pushed toward one another thereby moving latches 64*a*-64*f* of plugs 14*a*-14*f* from a latched to an unlatched position. Releasing the grasping force moves latches 64*a*-64*f* back to a latched position. Locking clip 68 has the further function of blocking tool (not shown but disclosed in U.S. patent application Ser. No. 12/013,225, filed Jan. 11, 2008, the contents of which are hereby incorporated by reference in their entirety) access to locking tabs 60-63*c* on housing clips 30, 32 thereby eliminating the possibility of removing a single plug 14*a*-14*f* from cassette assembly 10. Consequently, locking clip 68 has at least the dual function of maintaining plugs 14*a*-14*f* in cassette assembly 10, and maintaining the entire assembly 10 and corresponding patch cord connected to the switch or other electrical system such as a patch panel.

Locking clips 68 may be constructed of a number of suitable materials that can flex and is durable, such as plastic, a resilient metal such as spring steel or the like. Locking clip 68, in this example, is constructed of a generally U-shaped construction, as seen in FIGS. 9 and 10, with opposing arm members 70 each carrying a finger grip tab 72. Finger grip tabs 72 are positioned on opposing sides of clip 68. A user can grasp locking clip 68 with his or her thumb on one finger grip tab 72 and his or her opposing finger on the other opposing finger grip tab 72. A grasping or compression force can be exerted onto finger grip tabs 72 as represented by arrows 74, as shown in FIG. 10, thereby urging compression resistant member 76 together in a direction represented by arrows 78. As compression resistant member 76 compresses, distance designated by x, which represents a distance between two opposing portions of compression resistant member 76 in a relaxed state, is reduced. At the same time, opposing locking tabs 80, positioned on opposing sides of locking clip 68, are moved from a relaxed position for clip 68 at a spacing distance d to a distance less than distance d.

Figure 15:
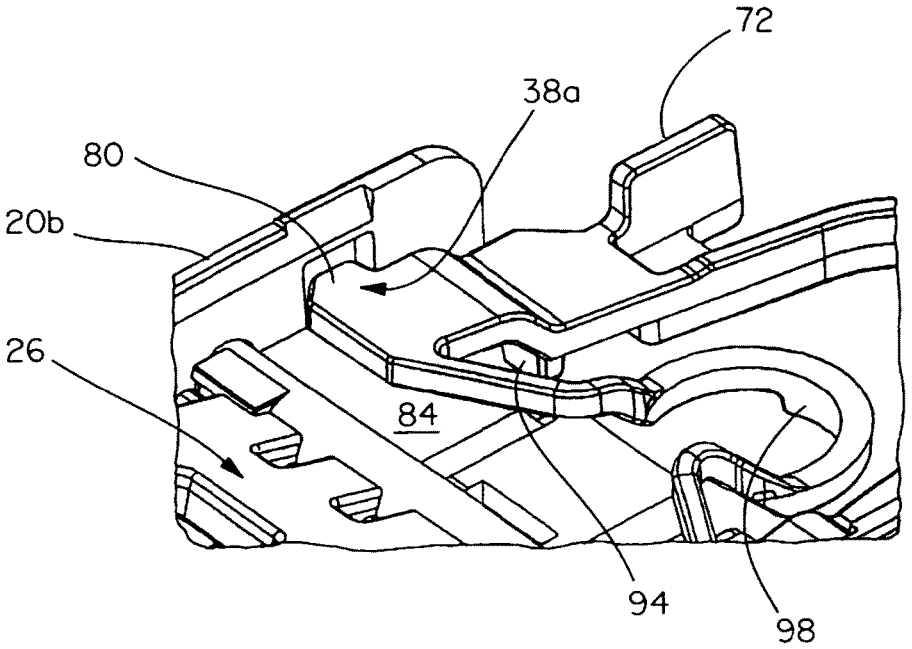
FIG. 15 is an enlarged view of detail 15 in FIG. 14.

Thus, with opposing tabs 80 drawn toward one another, clip 68 can be inserted into cassette assembly 10 between opposing sidewalls 20*a* and 20*b*, as seen in FIGS. 14 and 15. With opposing tabs 80 of locking clip 68 positioned in an upper portion of cassette assembly 10 between opposing sidewalls 20*a* and 20*b*, opposing tabs 80 can be positioned to be aligned with sidewall opposing apertures 38*a* of respective sidewalls 20*a* and 20*b*. Similarly, it should be noted that sidewall apertures 38*b* are positioned in opposing sidewalls 20*a*, 20*b* in the lower portion of cassette assembly 10 and receive locking tabs 80 of a locking clip 68 positioned in the lower portion of cassette assembly 10. The configuration for locking clips 68 and their engagement into cassette assembly 10 are the same for engaging the locking clips 68 in the upper or lower portion of cassette assembly 10.

Referring back to the upper portion of cassette assembly 10 with opposing tabs 80 positioned in alignment with sidewall opposing apertures 38*a*, the compression force 74 can be removed and opposing tabs 80 move back toward a more relaxed position thereby inserting opposing tabs 80 into sidewall opposing apertures 38*a*. Thus, with opposing tabs 80 positioned within opposing apertures 38*a*, locking clip 68 is locked into position within cassette assembly 10. To remove locking clip 68 from the upper portion of cassette assembly 10, opposing finger tabs 72 are urged toward one another until opposing tabs 80 are removed from opposing apertures 38*a*, at which time, locking clip can then be pulled out of cassette assembly 10. The same procedure is followed for installing and removing locking clip 68 from opposing apertures 38*b* in the lower portion of cassette assembly 10.

As seen in FIG. 11, locking clip 68 is positioned to be inserted into cassette assembly 10. In order to prevent upper release lever 22 and lower release lever 24 from being moved in a direction toward the other release lever, a locking clip 68 needs to be properly positioned adjacent to each of the upper and lower release levers 22, 24. Locking clip 68 is shown positioned adjacent to lower release lever 24 in FIG. 12. Locking clip 68 is positioned adjacent to upper release lever 22 in FIG. 16. With both locking clips 68 in position as set forth in FIGS. 12 and 16, neither release lever 22, 24 is capable of being moved toward the other release lever and all plugs 14*a*-14*f* remain locked into their electrical connections.

As previously discussed, release levers 22 and 24 are rotatably mounted to sidewalls 20*a* and 20*b* and in turn, release levers 22 and 24 are aligned with plug release actuators 26 and 28, respectively. Movement of release levers 22 and 24 toward each other causes plug release actuators 26 and 28 to engage plug latches 64*a*-64*f* of plugs 14*a*-14*f* and move latches 64*a*-64*f* to a release or unlock position to permit simultaneous disengagement of plugs 64*a*-64*f* from their electrical connections.

Figure 12:
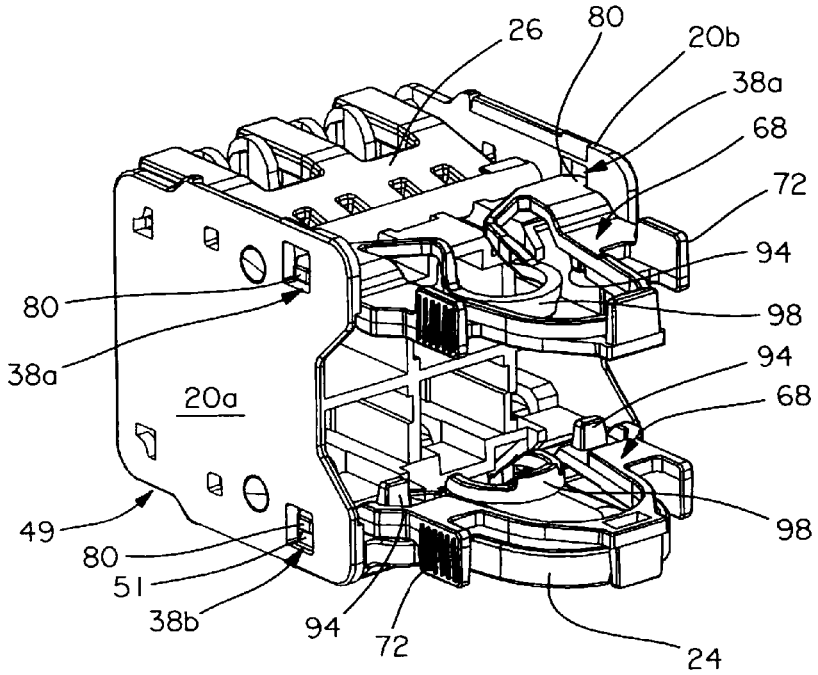
FIG. 12 is a rear perspective view of the cassette assembly of FIG. 11 with a locking clip positioned in an upper portion of the cassette assembly and the upper release lever removed and a locking clip positioned adjacent to the lower release lever in the lower portion of the cassette assembly.

With locking clip 68 positioned adjacent to release upper lever 22, as seen in FIG. 16, locking tabs 80 are engaged in opposing sidewall apertures 38*a*, the aperture 38*a* in sidewall 20*b* is not seen in FIG. 16 but is similarly positioned in sidewall 20*b* as to the one shown in sidewall 20*a*. Locking tabs 80 occupy opposing apertures 38*a* of opposing sidewalls 20*a*, 20*b*, at the same time, tabs 50 which are connected to upper release lever 22 and extend from opposing sides of lever 22 also occupy opposing apertures 38*a*. With tab 50 simultaneously occupying aperture 38*a* with locking tab 80, aperture 38*a* becomes substantially occupied and therefore restricts movement of upper release lever 22. Aperture 38*a* in sidewall 20*b* in FIG. 16 is not seen but takes on the same configuration as aperture 38*a* in sidewall 20*a*. As a result, opposing apertures 38*a* are both substantially occupied by tab 50 and locking tab 80. This arrangement is the same for restricting movement of lower release lever 24, as seen in FIGS. 12 and 14. Locking tabs 80 occupy opposing apertures 38*b*, positioned in sidewalls 20*a* and 20*b*, simultaneously with tabs 51 which are connected to lower release lever 24. Thus, with locking clips 68 positioned adjacent to upper and lower release levers 22 and 24, opposing apertures 38*a* and 38*b* are substantially occupied and release levers 22 and 24 are restricted from moving toward the other. As a result, actuators 26 and 28 are prevented from unlocking plugs 14*a*-14*f* from their electrical connection with their respective switches. Tabs 50, in this example, take on a generally triangular shape with the apex of the triangle extending away from lever 22.

Without locking tabs 80 positioned within apertures 38*a*, tabs 50 of lever 22 are permitted to move up and down within the confines of apertures 38*a* thereby permitting lever 22 to likewise move.

Locking clips 68, when in position, further restrict movement of release levers 22 and 24 by occupying space between a shelf within cassette assembly 10 which clip 68 abuts and release levers 22 and 24. In this regard FIG. 13 shows shelves 82 and 84 positioned in an upper portion of cassette assembly 10. Similarly, shelves 86 and 88 are positioned in a lower portion of cassette assembly 10. Because the arrangement of the upper release lever 22 and a corresponding locking clip 68 with respect to cassette assembly 10 is the same for lower release lever 24 and a corresponding locking clip 68 with respect to cassette assembly 10, upper release lever 22 is discussed herein and applies to the arrangement of lower release lever 24. In referring to FIGS. 14 and 15, it is shown that locking clip 68 rests upon shelves 82 and 84 in the upper portion of cassette assembly 10. With locking clip 68 in this position, it occupies space 89, shown in FIG. 7, which is the space defined between a bottom of upper release lever 22 and shelf 84. A similar space is defined between shelf 82 and upper release lever 22 on the other side of cassette assembly 10. Thus, with locking clip 68 in position occupying such spaces, upper release lever 22 is prevented from moving in a direction toward release lever 24 and thereby prevents plugs 14*a*-14*c* from becoming unlatched with respect to their electrical connection. Again, locking clip 68 occupies a similar space between release lever 24 and shelves 86 and 88 in the lower portion of cassette assembly 10 and prevents plugs 14*d-f* from becoming unlatched as well.

As a result, locking clips 68 restrict movement of release levers 22 and 24 in two fashions. In one fashion locking tabs 80 co-occupy sidewall opposing apertures 38*a* and 38*b* with tabs 50 and 51 which connect with release levers 22 and 24, resulting in apertures 38*a* and 38*b* becoming substantially occupied. In another fashion, locking clips occupy the space defined between release levers 22 and 24 and corresponding shelves 82, 84 and 86, 88, respectively.

Figure 17:
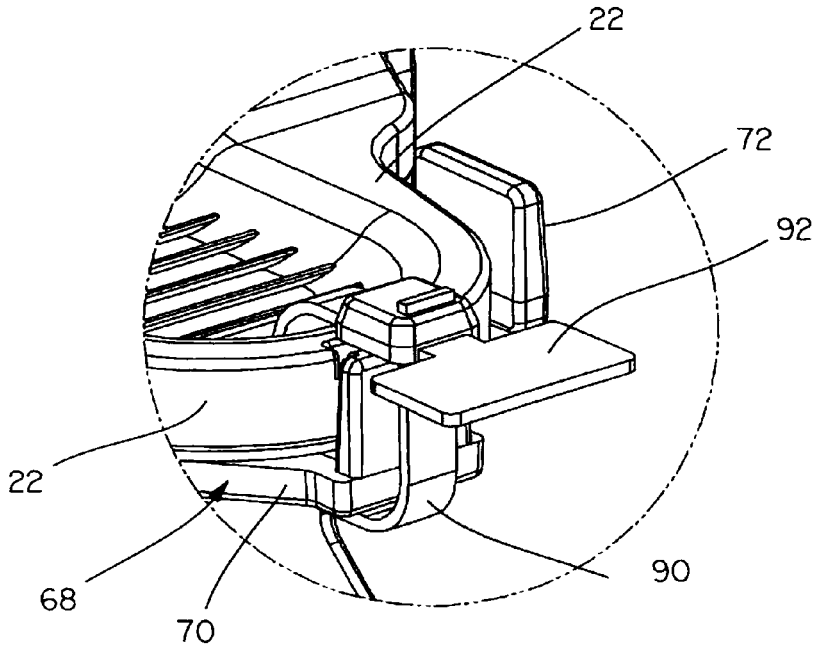
FIG. 17 is an enlarged view of detail 17 in FIG. 16.

In referring to FIGS. 16 and 17, locking clips 68 can be further secured in locking position. Locking clip 68, in locking position with respect to upper release lever 22, is secured to upper release lever 22 by use of cable tie 90. Cable tie 90 passes through an opening (not shown) in upper release lever 22 and passes around locking clip 68 and around the remainder of upper release lever 22. Cable tie 90 can be of a wide variety of locking or releasably locking constructions. In this embodiment, a locking cable tie is used that must be cut to remove it. Additionally, in this example, label 92 is provided as a portion of cable tie 90 and can be used for designating electrical connection information. A cable tie can likewise be employed to further secure locking clips 68 to lower release lever 24.

It should be understood that in this example, locking clips 68 are all generally constructed of the same size and shape and can be used for either locking an upper release lever 22 or a lower release lever 24.

An additional feature of locking clip 68 includes tabs 94, as seen in FIGS. 12, 14 and 15. Tab 94 in FIGS. 12, 14 and 15 extends from opposing sides of locking clip 68. With locking clip 68 in locking position with respect to upper release lever 22, as seen in FIG. 16, tabs 94 are positioned to block access to openings 96 within cassette assembly 10, seen in FIG. 13. With tabs 94 positioned in front of openings 96, access to plug latches 64*a* and 64*c* of plugs 14*a* and 14*c* are blocked thereby preventing someone from accessing such latches and individually unlocking plugs 14*a* and 14*c* from their electrical connection with upper release lever 22 in a locked position with locking clip 68. Tab 98 is provided in the example seen in FIG. 15. Tab 98 extends in the same direction as tabs 94 and blocks access to opening 99 as seen in FIG. 13. Tab 98 serves the same purpose as tabs 94, in that, tab 98 inhibits access to plug latch 64*b* of plug 14*b* preventing individually unlocking plug 14*b* with respect to its electrical connection with locking clip 68 in position. The same arrangement of tabs 94 and 98 blocks openings 101 and 103 positioned in a lower portion of cassette assembly 10, shown in FIG. 13. Thus, with locking clip 68 in position with relationship to lower release lever 24, tabs 94 and 98 block access to plug latches 64*d-f* of plugs 14*d-f*.

Figure 18:
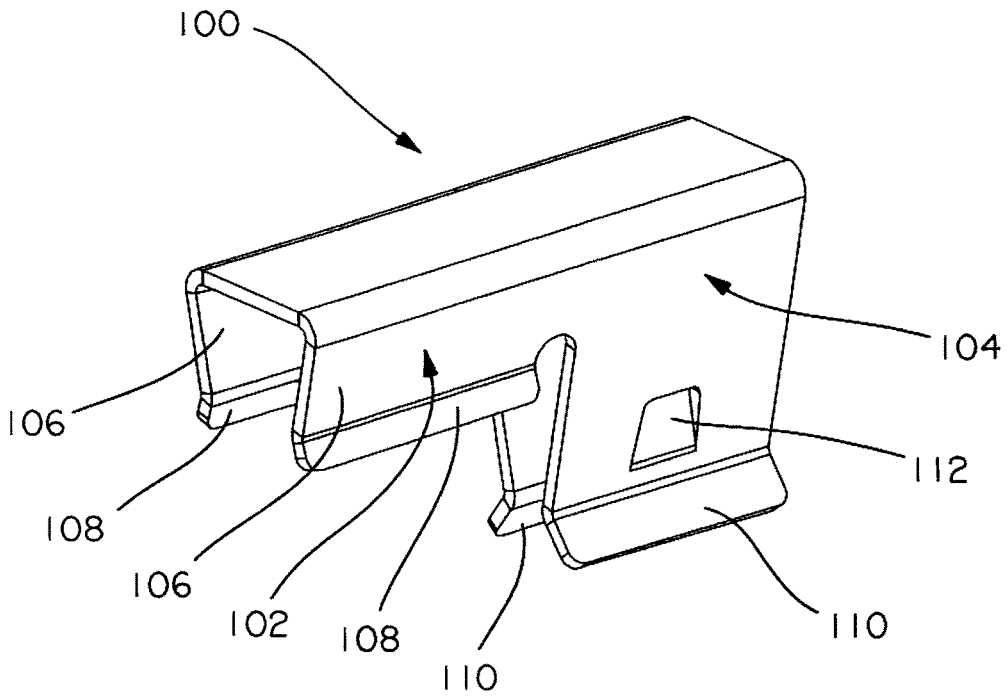
FIG. 18 is a perspective view of an embodiment of a bridge clip.
Figure 19:
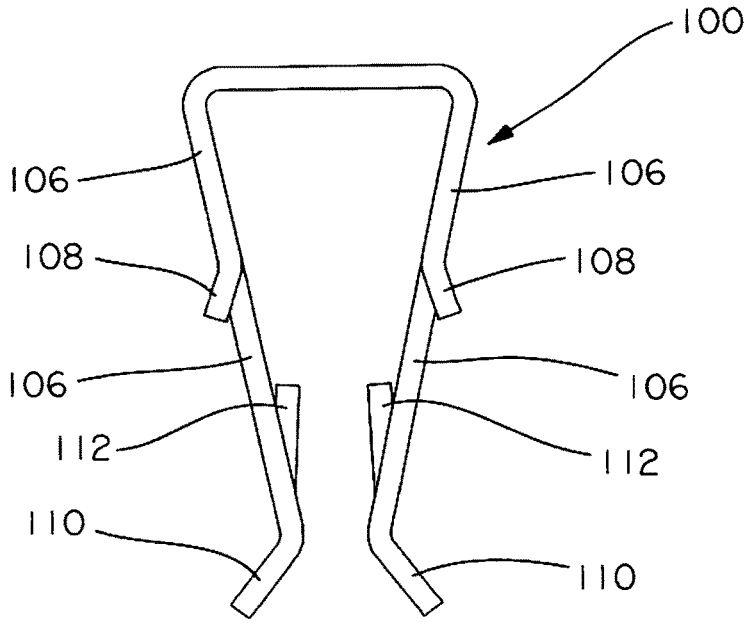
FIG. 19 is a front elevational view of the bridge clip of FIG. 18.
Figure 22:
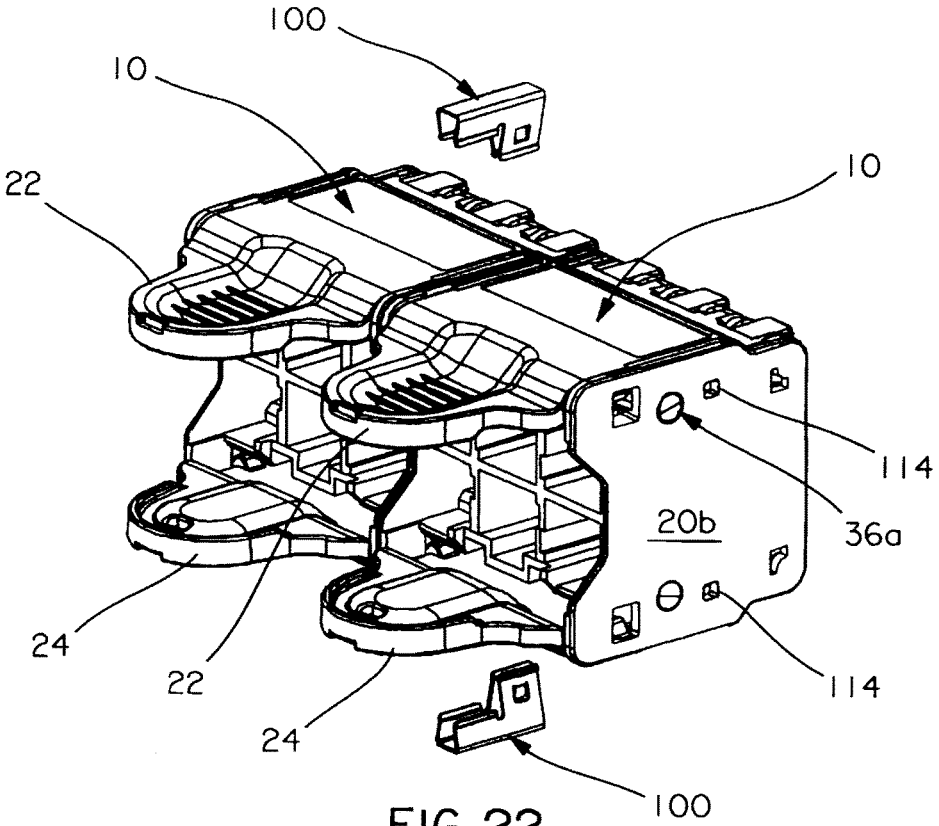
FIG. 22 is an exploded rear perspective view of two cassette assemblies which are positioned side by side and two bridge clips positioned to connect a top portion and a bottom portion of the two cassette assemblies.
Figure 23:
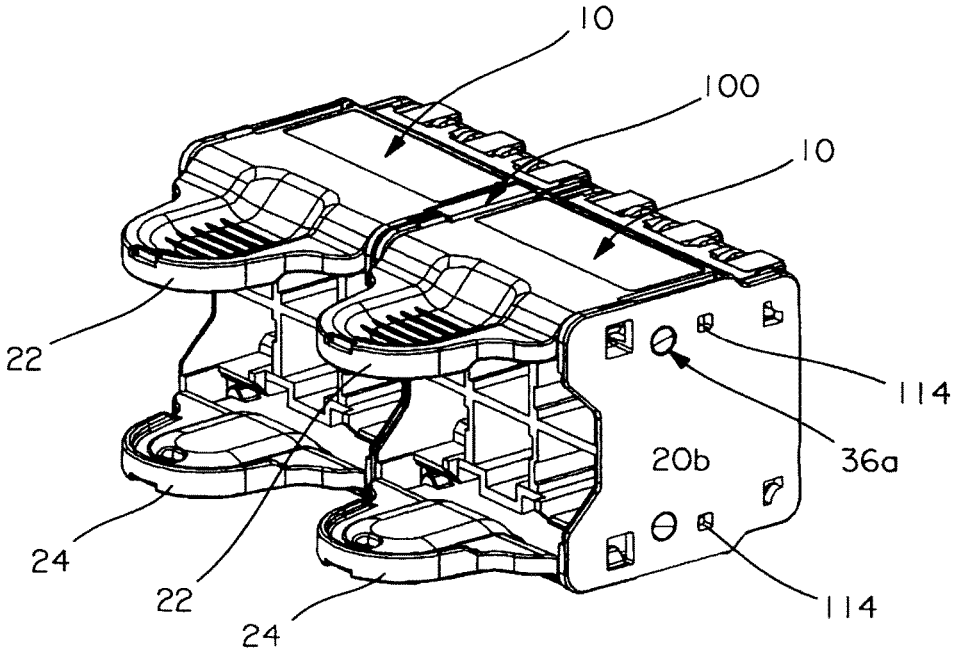
FIG. 23 is the rear perspective view of the two cassette assemblies of FIG. 22 with the bridge clip engaging the two cassette assemblies.

A further embodiment includes a bridge clip 100, as shown in FIGS. 18 and 19. Clip 100 is constructed of a spring steel material or the like and is used to align and secure two cassette assemblies 10 together in a side by side arrangement as seen in FIGS. 22 and 23. Typically, each cassette assembly 10 contains 6 or 8 positions for holding electrical connection plugs, thus with securing two cassettes 10 together side by side, one can provide for 12 to 16 plug connections which can be quickly released. This combining or ganging of cassette assemblies 10 provides for convenient and efficient electrical connections for conventional patch panels.

Figure 21:
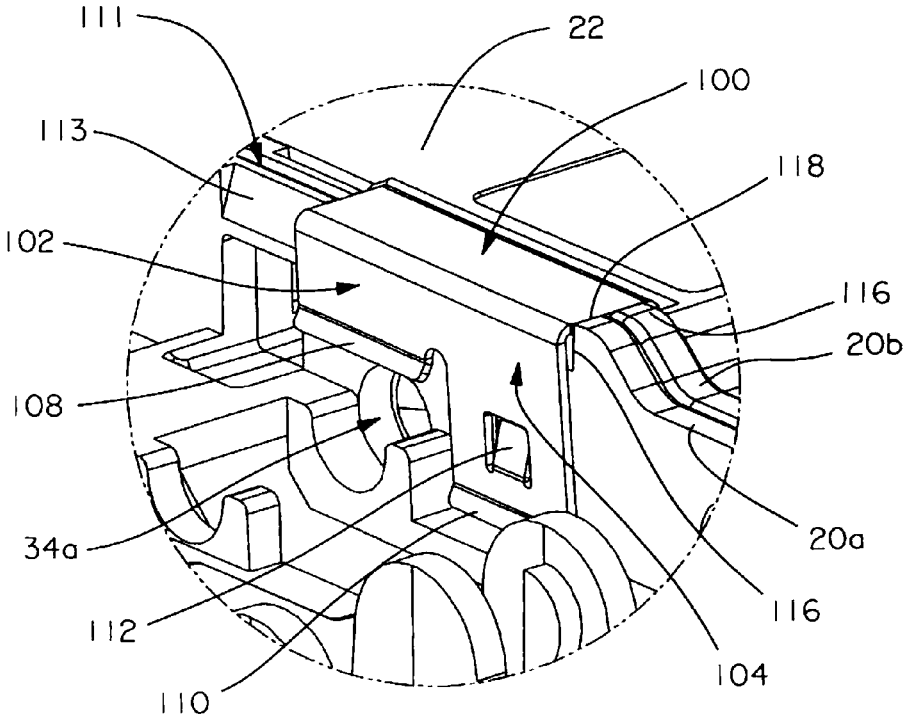
FIG. 21 is an enlarged view of detail 21 in FIG. 20.

In the example shown, bridge clip 100 forms a generally L shaped profile. The L-shaped configuration comprises a narrower body portion 102 and a wider body portion 104 which are each constructed of opposing converging or beveled sidewalls 106. Each of the narrower body portion 102 and the wider body portion 104 have lower portions 108 and 110 respectively that flair outwardly from converging opposing sidewalls 106. As is discussed herein, flair portions 108 and 110 will facilitate bridge clip 100 engaging sidewalls 20*a* and 20*b* of two adjacent cassette assemblies 10 and permit clip 100 to be slid over the top portion 111 of adjacent sidewalls 20*a* and 20*b*, as seen in FIG. 21.

The converging configuration of sidewalls 106 of clip 100 provides a gripping force with sidewalls 106 pulled apart from its relaxed position. In order for adjacent sidewalls 20*a* and 20*b* of two adjacent cassette assemblies 10 to be positioned within the converging sidewalls 106 of clip 100, sidewalls 106 need to be pulled slightly apart. With sidewalls 106 pulled slightly apart, opposing sidewalls 106 exert a confining force onto sidewalls 20*a* and 20*b*. To facilitate separating or pulling apart sidewalls 106 of clip 100, top edge 111 of each of the sidewalls 20*a* and 20*b* each define a beveled portion 113 (the beveled edge 113 of sidewall 20*b* is not shown but has the same configuration as that shown on sidewall 20*a* in FIG. 21.) Beveled edges 113 provide a narrower overall width of sidewalls 20*a* and 20*b* near the top edge 111. Flair portions 108 and 110 of clip 100 engage beveled edges 113 of each of sidewalls 20*a* and 20*b*. As force is applied to bridge clip 100 to urge clip 100 onto sidewalls 20*a* and 20*b*, flared portions 108 and 110 slide along beveled edges 113 and the width of the combined sidewalls 20*a* and 20*b* increases. As a result, sidewalls 106 of clip 100 thereby spread or pull apart. Beveled edges 113 and the flared portions 108 and 110 provide a smooth spreading apart of sidewalls 106 thereby permitting clip 100 to exert a gripping force upon sidewalls 20*a* and 20*b*.

In addition to the gripping force exerted on sidewalls 20*a* and 20*b*, in this example, bridge clip 100 locks onto adjacent sidewalls 20*a* and 20*b*. When locking tabs 112, as seen in FIGS. 18 and 19, are aligned with openings 114 in adjacent sidewalls 20*a* and 20*b* of adjacent cassette assemblies 10, tabs 112 extend into the space between converging opposing sidewalls 106 and into openings 114. With tabs 112 extending into openings 114, bridge clip 100 resists removal from its engagement of securing two adjacent cassette assemblies 10 because tabs 112 are oriented to engage an interior perimeter of openings 114 should a removing or lifting force be applied to clip 100.

With two cassette assemblies 10 positioned in a side by side relationship to one another, as shown in FIGS. 22 and 23, two clips 100, in this example, are engaged to sidewalls 20*a* and 20*b* of the adjacent cassette assemblies 10. One clip 100 is positioned on a top side of cassette assemblies 10 and another clip 100 is positioned on a bottom side of cassette assemblies 10. The use of two clips 100 to secure cassette assemblies 10 together provides a reliable securement.

Figure 20:
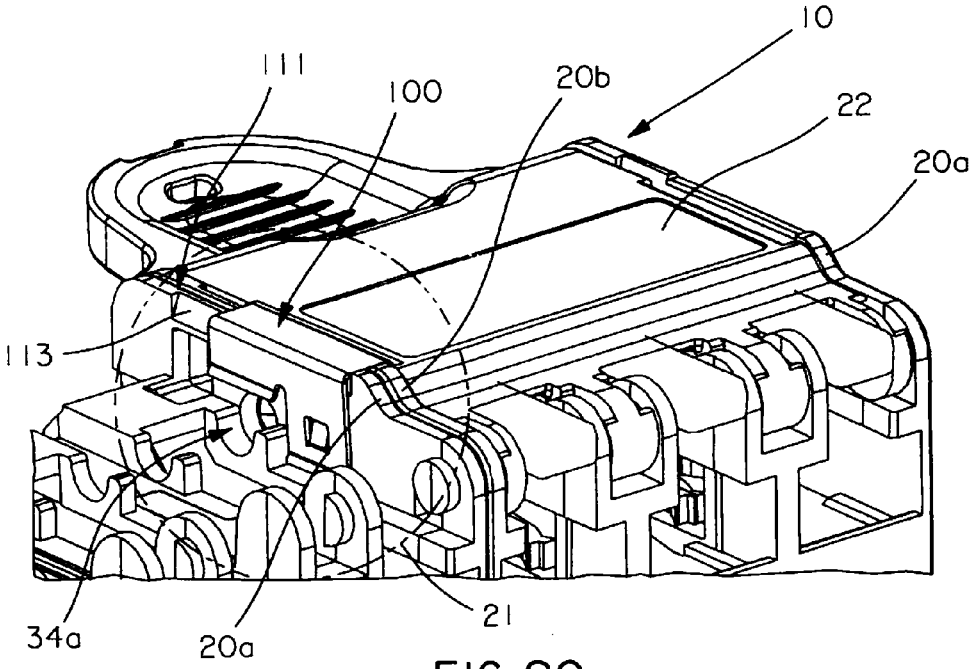
FIG. 20 is a rear perspective view of an embodiment of the cassette assembly positioned adjacent to another cassette assembly without an upper release lever and without an upper plug release actuator, wherein the bridge clip of FIG. 18 secures the cassette assemblies together.

In referring to FIGS. 20 and 21, circular aperture 34*a* is positioned in sidewall 20*a* of cassette assembly 10. Aperture 34*a*, as described above, supports cylindrical bar 46 of plug release actuator 26 which is associated with upper release lever 22. The same configuration is provided in the lower portion of cassette assembly 10 that is associated with lower release lever 24, however, for convenience, only circular aperture 34*a* will be described which is associated with upper release lever 22. Bridge clip 100 provides a narrower body portion 102 so as not to block the engagement of circular bar 46 of plug release actuator 26 with circular aperture 34*a* on sidewall 20*a* for one cassette assembly 10 and on sidewall 20*b* for the adjacent sidewall of other adjacent cassette assembly 10.

Wider body portion 104 provides assistance in aligning the fronts and backs of the two side by side cassette assemblies 10. Beveled edges 113 on top portion 111 of adjacent sidewalls 20*a* and 20*b* of the two side by side cassette assemblies 10 are of the same length and are similarly positioned on both cassette assemblies 10 in relationship to the front and back of each cassette assembly 10. End walls 116 are positioned at the end of each beveled edge 113 of each of the cassette assemblies 10 wherein end walls 116 are positioned approximately the same distance from the front and back of both cassette assemblies 10. Thus, when a user is securing two cassette assemblies 10 together with bridge clip 100, the user merely has to slide bridge clip 100 over sidewalls 20*a* and 20*b* and position end 118 of bridge clip 100 to abut end walls 116 of both sidewalls 20*a* and 20*b* of adjacent cassette assemblies 10. Thus, with end walls 116 of each adjacent cassette assembly 10 aligned with one another, the front and back sides of the two cassette assemblies 10 are aligned with each other.

While particular examples of the present invention have been shown and described, it will be obvious to those skilled in the relevant art that changes and modifications may be made without departing from the invention in its broader aspects. For example, while the present invention has been described in terms of patch cord cables and plugs connected to switches, this invention is applicable to virtually any combination of plug and socket combinations for transmitting electrical signals. The matter set forth in the foregoing description and accompanying drawings is offered by way of illustration only and not as a limitation.

What is claimed:

1. A communication cord assembly, comprising:

a plurality of communication cords including a plurality of communication plugs, each said plug including a respective latch; and a cassette assembly including a housing for receiving said plurality of plugs, at least one lever connected to said housing, said at least one lever positioning each said latch into an unlatched position, said at least one lever including an engaging portion to facilitate removal of said plurality of plugs from a plurality of respective jacks wherein said housing includes a top side and a bottom side, said at least one lever includes a first lever on said top side and a second lever on bottom second side.

2. The communication cord assembly of claim 1, wherein said housing includes a plurality of receptacles where each said receptacle receives a respective said plug.

3. The communication cord assembly of claim 2, wherein each said receptacle includes a feature allowing a tool to be inserted into said receptacle adjacent said respective plug to facilitate removal of said respective plug from said receptacle without disturbing other said plugs.

4. The communication cord assembly of claim 3, wherein said feature is a slot.

5. The communication cord assembly of claim 3, wherein said tool is a screwdriver.

6. The communication cord assembly of claim 2, wherein said plurality of receptacles includes two rows of said receptacles.

7. The communication cord assembly of claim 2, further including a locking clip for locking respective said plugs in respective said receptacles.

8. The communication cord assembly of claim 1, further including a second housing connected to said housing with a bridge clip.

9. A communication cord assembly, comprising:

a plurality of communication cords including a plurality of communication plugs; and a cassette assembly including a housing for receiving said plurality of plugs, said housing having a plurality of receptacles where each said receptacle receives a respective said plug, at least one said receptacle having a feature allowing a tool to be inserted into said receptacle adjacent said respective plug to facilitate removal of said respective plug from said receptacle without disturbing other said plugs.

10. The communication cord assembly of claim 9, wherein said feature is a slot.

11. The communication cord assembly of claim 9, wherein said tool is a screwdriver.

12. A communication cord assembly, comprising:

a plurality of communication cords including a plurality of communication plugs; and a cassette assembly including a housing for receiving said plurality of plugs, said housing having a plurality of receptacles where each said receptacle receives a respective said plug, said cassette assembly including a housing clip removably connected to the housing, at least a portion of said housing clip blocking a path of removal of said respective plug from said receptacle.

13. The communication cord assembly of claim 12, wherein a first portion of said housing clip blocks a first path of removal of a first plug and a second portion of said housing clip blocks a second path of removal of a second plug.

14. The communication cord assembly of claim 12, wherein said cassette assembly includes a plurality of walls forming said receptacles and separating each said receptacle from the other receptacles.

* * * * *